US010914173B2

(12) United States Patent
Kroell

(10) Patent No.: US 10,914,173 B2
(45) Date of Patent: Feb. 9, 2021

(54) SPHERICAL ENERGY CONVERTER

(71) Applicant: André Kroell, Gauting (DE)

(72) Inventor: André Kroell, Gauting (DE)

( * ) Notice: Subject to any disclaimer, the term of this patent is extended or adjusted under 35 U.S.C. 154(b) by 0 days.

(21) Appl. No.: 16/971,962

(22) PCT Filed: Jan. 8, 2019

(86) PCT No.: PCT/DE2019/000002
§ 371 (c)(1),
(2) Date: Aug. 21, 2020

(87) PCT Pub. No.: WO2019/161819
PCT Pub. Date: Aug. 29, 2019

(65) Prior Publication Data

US 2020/0392845 A1 Dec. 17, 2020

(30) Foreign Application Priority Data

Feb. 21, 2018 (DE) ..... 20 2018 000 899 U

(51) Int. Cl.
*F01C 1/063* (2006.01)
*F01C 1/077* (2006.01)
(Continued)

(52) U.S. Cl.
CPC ..... *F01C 1/077* (2013.01); *F01C 1/063* (2013.01); *F01C 19/005* (2013.01); *F01C 21/18* (2013.01); *F03C 2/02* (2013.01)

(58) Field of Classification Search
CPC ..... F01C 1/063; F01C 1/077; F01C 19/005; F01C 21/18
See application file for complete search history.

(56) References Cited

U.S. PATENT DOCUMENTS 3,294,071 A * 12/1966 Turco ..... F01C 1/063 418/35
3,549,286 A 12/1970 Moriarty
(Continued)

FOREIGN PATENT DOCUMENTS

DE 2608479 A1 9/1977
DE 202009016021 U1 4/2010
(Continued)

OTHER PUBLICATIONS

Niemann: "Machine Elements—Designing, Calculating and Constructing in Mechanical Engineering, a Textbook and Workbook", Second Volume, Gearing, Springer-Verlag, 1961, 4 pages.
(Continued)

*Primary Examiner* — Audrey K Bradley
(74) *Attorney, Agent, or Firm* — Skaar Ulbrich Macari, P.A.

(57) ABSTRACT

The invention relates to a spherical working chamber and to two flat rotary pistons as internally turning, rotating pistons that are used to produce energy, which flat rotary pistons are driven by means of a descent of creeks, rivers or gray water and rainwater from high-rise buildings. Because of the even rotation of the output shaft of the flange-mounted transmission, an electrical generator can be connected. The energy converter plus generator can also be used as a mobile unit in emergency situations at waterfalls in order to generate electricity.

5 Claims, 5 Drawing Sheets

(51) Int. Cl.

| | |
|---|---|
| ***F01C 19/00*** | (2006.01) |
| ***F01C 21/18*** | (2006.01) |
| ***F03C 2/02*** | (2006.01) |

(56) References Cited

U.S. PATENT DOCUMENTS

| | | | | |
|---|---|---|---|---|
| 3,801,237 | A * | 4/1974 | Gotthold | F01C 1/063 418/36 |
| 2013/0129476 | A1 | 5/2013 | Bekking | |
| 2018/0030858 | A1* | 2/2018 | Gormat | F02G 1/02 |

FOREIGN PATENT DOCUMENTS

| | | | |
|---|---|---|---|
| GB | 412006 | A | 6/1934 |
| GB | 2052639 | A | 1/1981 |

OTHER PUBLICATIONS

International Preliminary Report on Patentability rendered by the International Bureau of WIPO for PCT/DE2019/000002, dated Apr. 16, 2020, 6 pages.

* cited by examiner

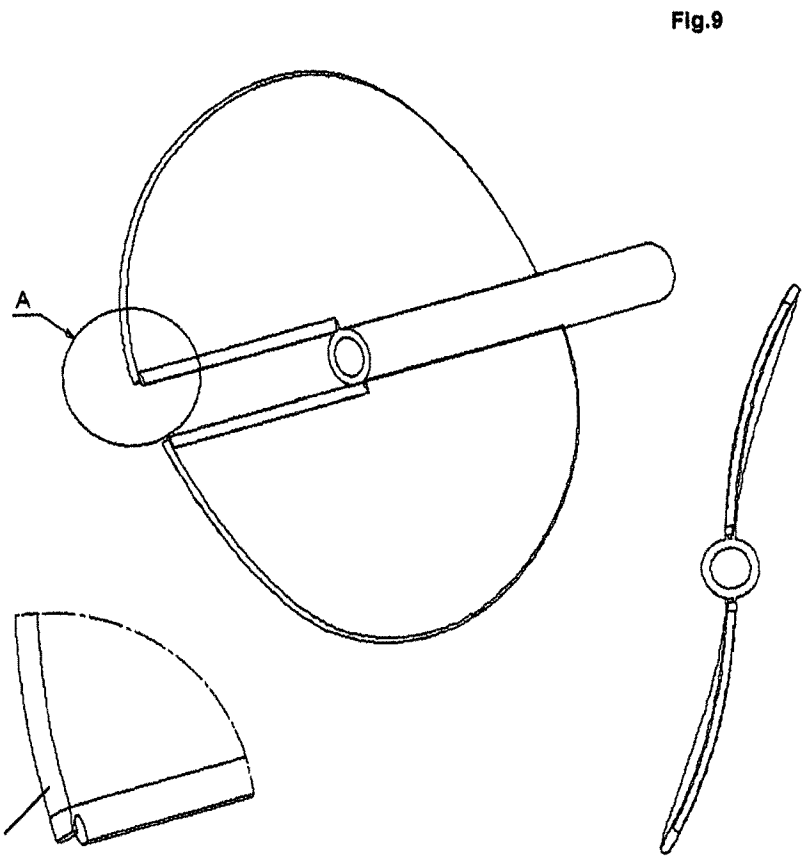
Fig.9
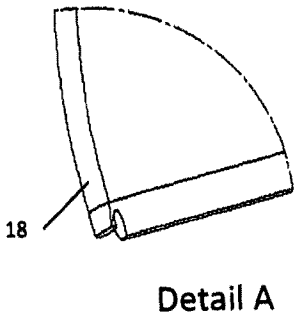
Fig.10
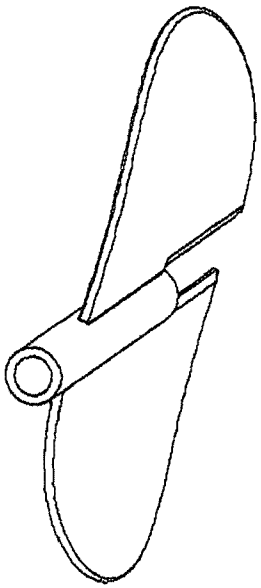
Fig.11
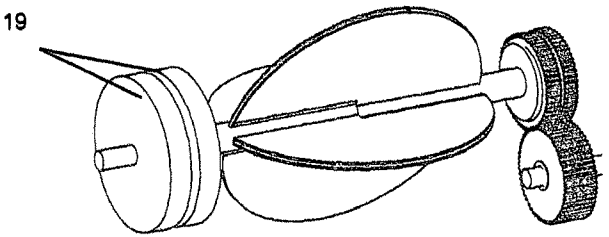

SPHERICAL ENERGY CONVERTER

PRIORITY

This application claims the benefit of German Patent Application No. 202018000899.0, filed on Feb. 21, 2018, and which is hereby incorporated herein by reference in its entirety.

FIELD

The invention relates to a spherical energy converter for generating electricity, having a housing which confines a rotationally symmetrical working chamber.

A double set of identical flat rotary pistons on concentric axes in a spherical working chamber offers high efficiency for fluids in a compact design.

The invention relates to the conversion of energy of fluid masses into mechanical energy, which can be further converted into electrical energy.

In particular, the generators have a spherical working chamber and flat rotary pistons as internally rotating pistons.

BACKGROUND

There are some proposals for energy conversion machines having a spherical working chamber, which—at least theoretically—are the most effective and most compact constructions. However, no construction has hitherto achieved the theoretical expectations and goals.

Some intellectual property rights and applications relate to rotating piston machines, and some of these relate to the specific form of spherical working chambers, such as in GB 2052 639 and DE 26 08 479. In the case of these, a working chamber or pump chamber is spatially divided by a piston plate into multiple chamber volumes which are varied by way of their rotation about two axes.

This can be achieved through guidance in wedge-shaped grooves within the wall of the working chamber, as in wobble ring pumps (for example U.S. Pat. No. 3,549,286).

However, it has been shown that such wobbling movements in slot guides are possible only for low rotational speeds and preferably in pumps for highly viscous media. Thus, use thereof in drive machines is not possible, since the piston plates are unavoidably clamped in the grooves if the pressure loading does not increase uniformly.

PCT/NL 2011/050 475 or WO 2012/002816 appears to provide a solution to the problem, although the combination of multiple concentric chamber segments with the piston plate produces a highly segmented movement sequence with different pressure levels, which forces control thereof through the combination of multiple rotation chambers. However, this of course means much greater technical effort.

Furthermore, also known from DE 20 2009 016 021 U1 is an internal combustion engine having multiple circular or semicircular piston disks which are movable about an axis.

However, there is a problem with the amount of waste heat of an internal combustion engine. The dissipation over the relatively small surface of a spherical working chamber alone is barely sufficient for cooling unless considerable effort is put into a pressure cooling system, this on the other hand counteracting efficiency.

Furthermore, this construction inherits a segmented movement interrupted by stoppers, which not only reduces efficiency but also causes mechanical problems.

Together with the abrupt movement of flat vanes, this leads to detrimental vibration patterns.

SUMMARY

It is therefore an object of the present invention to provide a system capable of efficient conversion of energy in the form of flowing or gaseous masses into rotation and, in this way, efficient conversion thereof into electrical energy.

The basic construction therefore relates to DE 2 200901 6 021 U1, which originates from the present inventor.

A) There is no longer an intermittent stop by the locking devices.

B) The flat rotary pistons are identically deformed for resisting resonances such that vibrations are unlikely and there is no propagation of the latter.

C) The application is now directed toward water turbines and air pressure systems which, by contrast to the use of internal combustion engines, work with uniform loading of their media. However, the basic advantages of the spherical working chambers and vanes therein are maintained: high efficiency, owing to the fact that the friction of the vanes in a sphere is much less in comparison with pistons in a cylinder or other, even less effective designs.

BRIEF DESCRIPTION OF THE DRAWINGS

A preferred exemplary embodiment of the invention will be explained in more detail below on the basis of the drawings.

In the drawings:

FIG. 9 shows the spherical design of the flat rotary pistons.

FIG. 10 shows, on a larger scale, a detail of the flat rotary piston with a sealing strip.

FIG. 11 shows an illustration of the flywheels.

Figure 1:
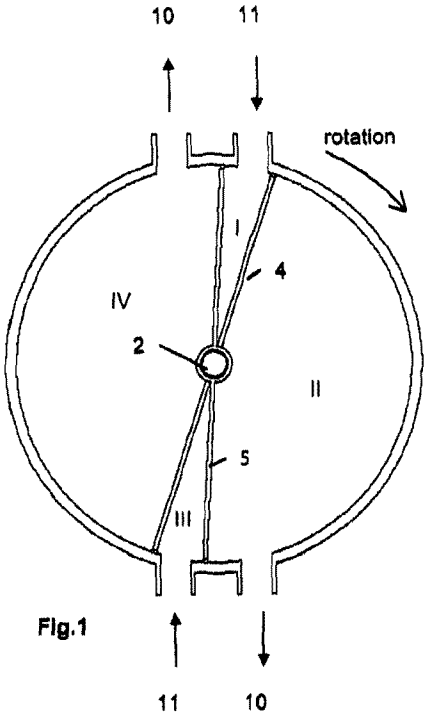
FIG. 1-FIG. 4 show the basic principle in a schematic illustration. The views neglect the deformation of the flat rotary pistons.
Figure 2:
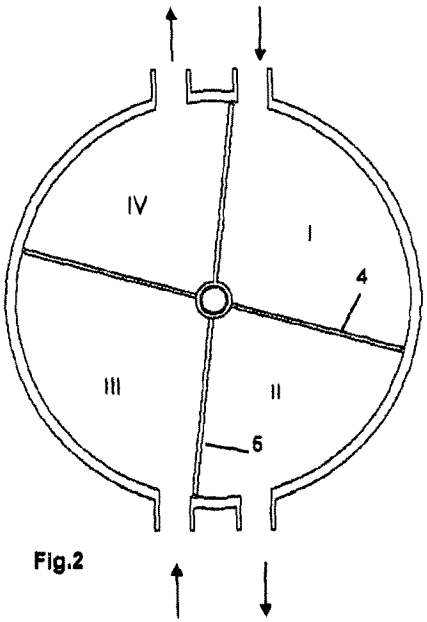
Figure 3:
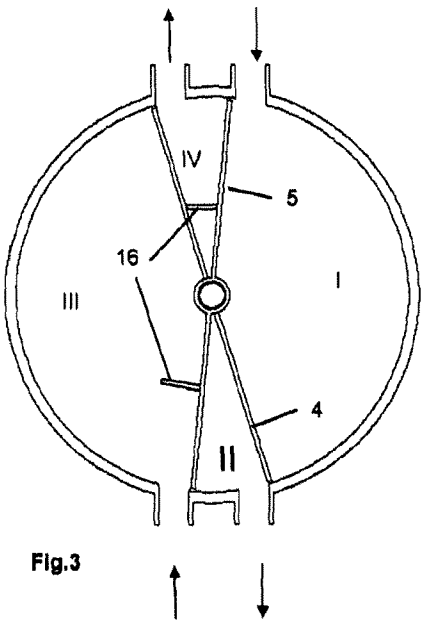

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various exemplary embodiments. Nevertheless, these embodiments are not intended to limit the present invention to any specific example, environment, application, or particular implementation described herein. Therefore, descriptions of these example embodiments are only provided for purpose of illustration rather than to limit the present invention.

Figure 8:
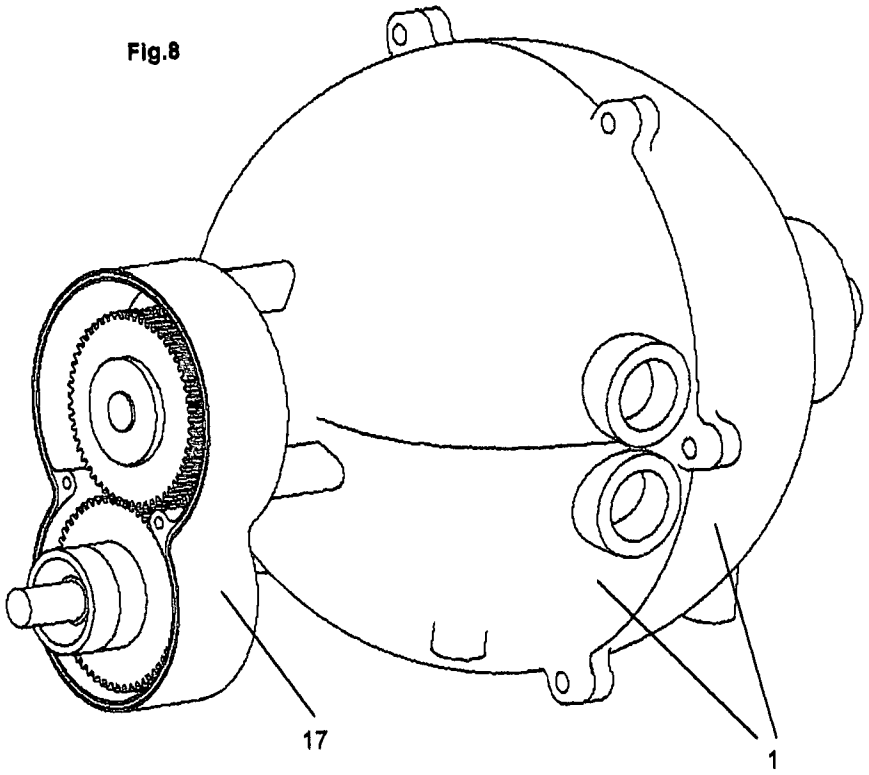
FIG. 8 shows an overall view without the gearing cover.

The spherical energy converter shown in FIG. 8 consists of a housing 1 which confines a spherical working chamber.

Mounted in the housing 1 are 2 hollow shafts 3*a* and 3*b*, whose axes coincide with a diameter of the spherical housing 1.

Figure 5:
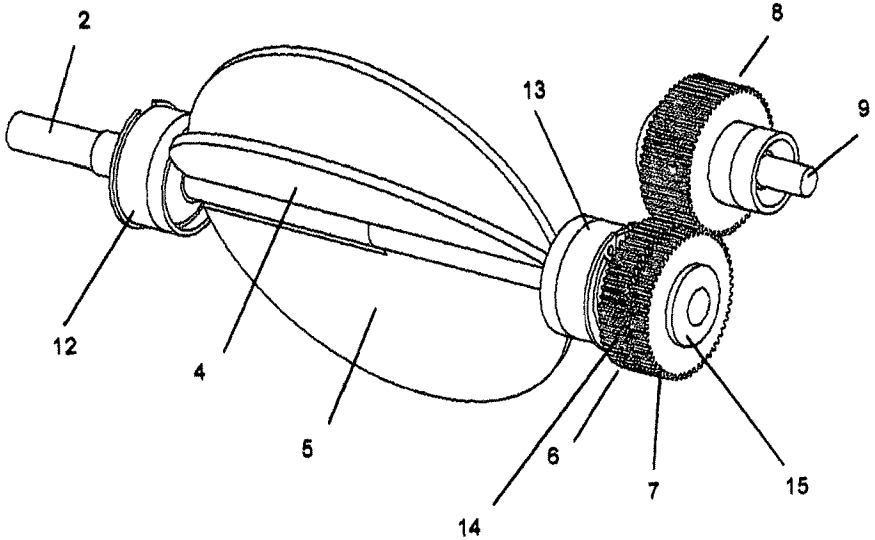
FIG. 5 shows the perspective view of the complete inner drive unit, with the gearing included.

As can be seen from FIG. 5 the hollow shafts 3*a* and 3*b* have been pushed on the shaft 2. The spherical flat rotary pistons 4 and 5 are respectively connected fixedly to the hollow shaft 3*a* and 3*b*. Welding, casting from one piece or milling from one part are options.

The hollow shaft 3*a* is connected torque proof to the shaft 2 by way of a wedge-shaped groove, bolt or welding, while the hollow shaft 3*b* is rotatably mounted.

The two spherical flat rotary pistons have a circular profile such that they bear sealingly against the inner wall of the housing 1. Put more precisely, each spherical flat rotary piston 4, 5 consists of two spherical semicircular vanes. The two spherical vanes are connected torque proof to the hollow shaft 3*a* and 3*b* in the first half of the straight region of their base line. The second half of the base line slides sealingly over the opposite hollow shaft 3*a* or 3*b*.

The two spherical flat rotary pistons 4, 5 consequently confine in the housing 1 a total of 4 chambers I, II, III and IV, as shown in FIGS. 1-4.

As shown in FIG. 10 a groove is cut out in the sealing surfaces of the spherical flat rotary pistons 4, 5, into which groove a seal 18 is inserted.

As illustrated in FIG. 5 the hollow shaft 3*b*, by way of the outer right-hand end, is connected via a freewheel clutch 14 to the toothed gear 6, and a toothed gear 7 is connected via a freewheel clutch 15 to the outer end of the shaft 2, which outer end projects from the hollow shaft 3*a*.

The two toothed gears 6 and 7 mesh with a toothed gear 8 which is connected torque proof to an output shaft 9 which is parallel to the shafts 2, 3.

Functioning Principle

FIG. 1 The medium (gas or liquid) enters the chambers I and III through the inlet openings 11 continuously.

Figure 7:
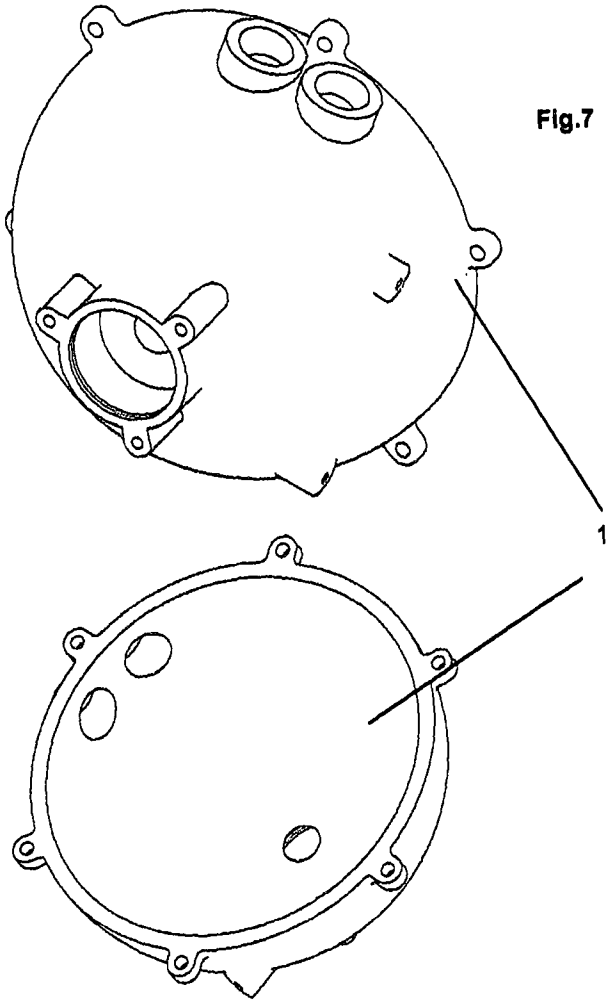
FIG. 7 shows the housing halves.

Accordingly, the flat rotary piston 4 is pushed in a forward direction of rotation, while the rear flat rotary piston 5 would then be driven backward. However, since a freewheel bearing 13 in FIG. 5 activates between the hollow shaft 3*b* and the housing 1 in FIGS. 7, 8 the flat rotary piston 5 is blocked from rotating backward.

When the front flat rotary piston 4 is pushed forward, the medium in II and IV is subjected to pressure and is pressed out via the outlet openings 10.

By way of the rotational movement of the flat rotary piston 4 (see FIG. 2) which is connected torque proof to the hollow shaft 3*a* and the shaft 2, the toothed gear 7 is driven by the blocked clamping body freewheel 15.

Figure 4:
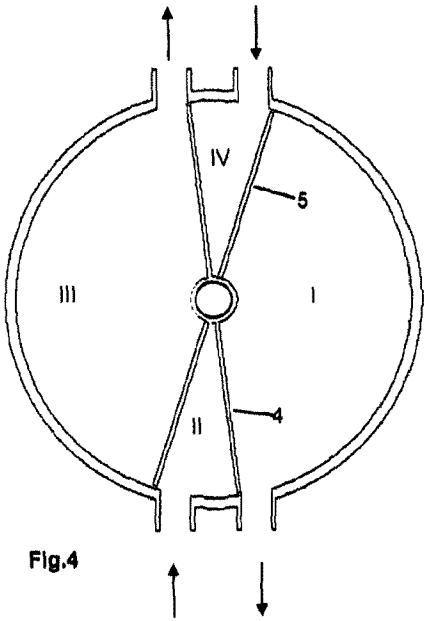
Figure 6:
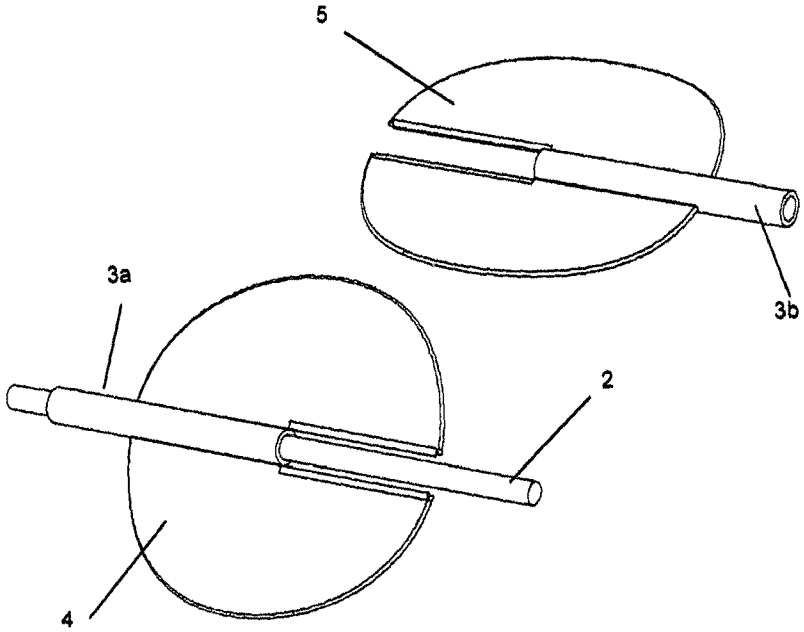
FIG. 6 shows the primary individual parts in a perspective view.

The toothed wheel 7, by way of the meshing, transmits the rotational movement to the output toothed gear 8, and the output shaft 9, which is fastened to the output toothed gear 8, rotates. As soon as the shaft 2 stops after the working stroke, the clamping body freewheel 15 allows the toothed gear 7 to continue to rotate on the shaft. Pushing-onward of the flat rotary piston 5, as can be seen in FIG. 4 can be achieved by the following options:

A) An engagement bolt 16 which is fastened to the flat rotary piston 4 pushes the flat rotary piston 5 into the next position.

B) A flywheel 19 (FIG. 11) is fastened to the each of hollow shaft 3*b* and the shaft 2, said flywheels pushing the flat rotary pistons beyond the dead center.

As soon as the flat rotary piston 5 is rotated over the inlets 11, the pressure builds up in the chambers II and IV.

The flat rotary piston 5 is now pushed in a forward direction of rotation, while the rear flat rotary piston 4, which is connected torque proof to the clamping body freewheel 12 in FIG. 5 is prevented from giving way into the opposite direction.

The clamping body freewheel 12 is inserted into the housing 1 and secured against rotation. When the flat rotary piston 5 is pushed forward, the medium in I and III is subjected to pressure and is pressed out via the outlet openings 10.

By way of the rotational movement of the flat rotary piston 5 (see FIG. 4), which is connected torque proof to the hollow shaft 3*b*, the toothed gear 6 is driven by the blocked clamping body freewheel 14 (in the toothed gear 6, not visible).

The toothed wheel 6, by way of the meshing, transmits the rotational movement to the output toothed gear 8, and the working shaft 9, which is fastened to the output toothed gear 8, rotates. As soon as the hollow shaft 3 stops after the working stroke, the toothed gear 6 can continue to rotate on the shaft due to the clamping body freewheel 14. This process is repeated continuously.

As has been explained above, when the spherical energy generator operates, stepwise rotation of the two flat rotary pistons 4, 5 occurs, wherein, in an alternating manner, one of the two flat rotary pistons performs a working stroke. A working torque is therefore exerted clockwise on the hollow shaft 3*b* and the shaft 2 in an alternating manner. The clamping body freewheels 14, 15 assigned to the two toothed gears act so that the shaft 2 or the hollow shaft 3*b* can transmit a drive torque to the assigned toothed gear 7 or 6 in a direction of rotation. However, a toothed gear 6 or 7 driven by the output toothed gear 8 can overrun the corresponding, non-driven shaft 2 or hollow shaft 3*b*.

The braking action between the flat pistons 4, 5 can be determined via the spacing between the outlet 10 and the inlet opening 11 on the housing 1.

The spherically deformed flat rotary pistons (FIG. 9) can counteract the resonance such that vibrations are unlikely and there is no propagation of the latter.

The semicircular seal 18 (FIG. 10) which bears against the inner surface of the housing 1, is preferably inserted with pretension into the corresponding groove of the flat rotary piston 4, 5, in order that, with increasing wear, said seal can expand radially such that the sealing action is maintained.

Figure 12:
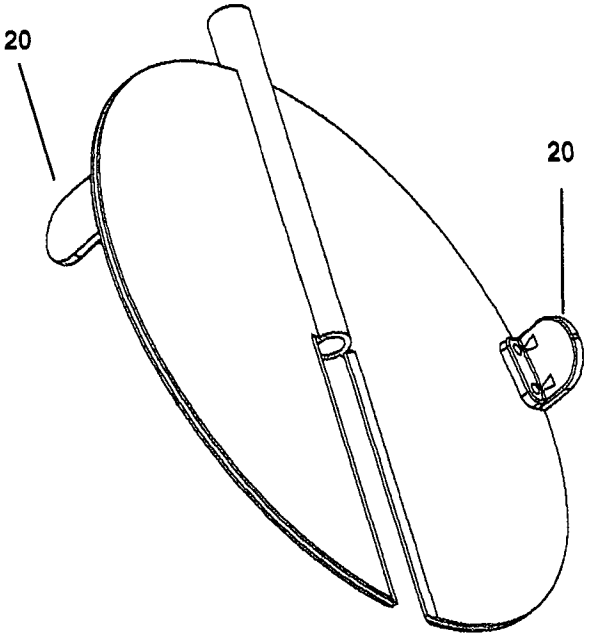
FIG. 12 shows an illustration of the shut-off slides.

The control times and thus the efficiency can be optimized by way of shut-off slides 20 (FIG. 12) on the flat rotary pistons.

Figure 13:
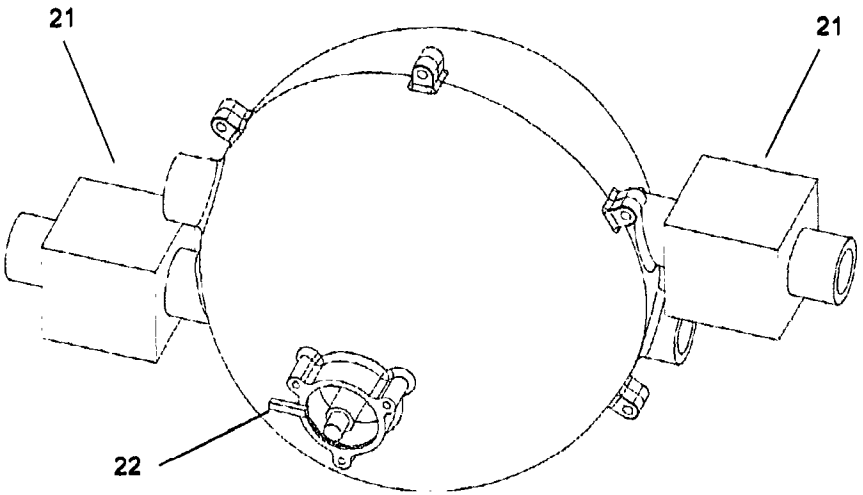
FIG. 13 shows the attachment of a sensor and solenoid valves.

The efficiency can be increased through the attachment of sensors 22 and electronically controlled solenoid valves 21 to the inlets 11 (FIG. 13).

Here are some proposals for the spherical energy converter:

A) In the basement of high-rise buildings, the spherical energy converter may be used for generating electricity by being driven from rainwater or waste water.

B) Use in a tidal power plant, which converts potential and kinetic energy from the tidal range of the sea into electricity, would be conceivable.

C) Use in river power plants would be advantageous since, owing to the high efficiency, only small pressure differences in the water fall height would be required.

D) The energy converter, as a mobile unit, could be used at waterfalls in times of crisis.

E) Use in compressed-air storage power plants would also be conceivable.

The present invention has been described in detail on the basis of exemplary embodiments for explanatory purposes. However, it is clear to a person skilled in the art that features of the described exemplary embodiments can be combined with features of other exemplary embodiments within the scope of the invention and that it is possible to deviate from the exemplary embodiments within the scope of the invention.

LIST OF REFERENCE SIGNS

1 Housing
2 Shaft
3*a* Hollow shaft
3*b* Hollow shaft
4 Flat rotary piston
5 Flat rotary piston
6, 7 Toothed gear
8 Output toothed gear
9 Output shaft
10 Outlet
11 Inlet
12 Clamping body freewheel
13 Clamping body freewheel
14 Clamping body freewheel
15 Clamping body freewheel
16 Stop bolt
17 Gearing housing
18 Sealing strip
19 Flywheel
20 Shut-off slide
21 Solenoid valve
22 Sensor

The invention claimed is:

1. An energy converter comprising a) a housing which confines a spherical working chamber and in which two inlet openings and two outlet openings for a pressurized liquid or gaseous medium are arranged;

b) a shaft and a hollow shaft receiving the latter, which are mounted rotatably in the housing, wherein each of an axis of rotation of the shaft and an axis of rotation of the hollow shaft coincide with a diameter of the working chamber;

c) two flat rotary pistons which bear sealingly against an inner wall of the housing and have a circular profile, wherein one of the flat rotary pistons is connected torque proof to the shaft and the other flat rotary piston is connected torque proof to the hollow shaft;

d) two toothed gears which are connected to either the shaft or to the hollow shaft via a first freewheel coupling, the first freewheel coupling preventing rotation of the toothed gears with respect to the shaft or the hollow shaft counter to the working direction of rotation; and e) an output toothed gear which meshes with the two toothed gears, wherein:

f) in the housing, the two inlet openings are arranged opposite one another and the two outlet openings are arranged opposite one another, g) the shaft and the hollow shaft are each supported in the housing via a second freewheel coupling, the second freewheel coupling preventing rotation of the shaft or of the hollow shaft counter to the working direction of rotation, and h) the two flat rotary pistons are each assigned stop bolts which come into engagement with the respective other flat rotary piston, and to move the latter across the two inlet openings, at the end of a working cycle.

2. The energy converter of claim 1, wherein a plurality of flywheels are disposed on the shaft and on the hollow shaft.

3. The energy converter of claim 1, wherein both flat rotary pistons are of identical spherical form.

4. The energy converter of claim 1, wherein a circumference of the two flat rotary pistons is in each case assigned two semicircular seals.

5. The energy converter of claim 4, wherein the two semicircular seals bear under pretension against the inner wall of the housing.

* * * * *